United States Patent [19]

Williams et al.

[11] 4,297,427

[45] Oct. 27, 1981

[54] POLYBLEND COATED CARRIER MATERIALS

[75] Inventors: Meurig W. Williams; Christopher J. AuClair, both of Rochester, N.Y.

[73] Assignee: Xerox Corporation, Stamford, Conn.

[21] Appl. No.: 872,518

[22] Filed: Jan. 26, 1978

[51] Int. Cl.[3] ..... G03G 9/10

[52] U.S. Cl. ..... 430/108; 430/121; 430/122; 428/407; 428/421

[58] Field of Search ..... 252/62.1 P; 428/421, 428/407; 96/150; 430/108, 121, 122

[56] References Cited

U.S. PATENT DOCUMENTS 3,507,686 4/1970 Hagenbach ..... 252/62.1 P 3,526,533 9/1970 Jacknow et al. ..... 252/62.1 P

*Primary Examiner*—John D. Welsh

*Attorney, Agent, or Firm*—E. O. Palazzo; R. J. Grandmaison

[57] ABSTRACT

Electrostatographic developer mixtures comprising finely-divided toner particles electrostatically clinging to the surface of carrier particles comprising a core having an outer coating thereon comprising a polyblend of a first polymer possessing negative triboelectric charging characteristics with respect to toner particles and a second polymer which possesses strong adhesive properties with respect to said core. The coated carrier particles have negative triboelectric charging properties and are particularly useful in development of negatively charged photoreceptors. Imaging processes are also disclosed.

9 Claims, No Drawings

POLYBLEND COATED CARRIER MATERIALS

BACKGROUND OF THE INVENTION

This invention relates to electrostatographic imaging systems and more specifically to improved carrier compositions useful in the development of electrophotographic images.

It is well known to form and develop images on the surface of photoconductive materials by electrostatic means, one of the more basic systems being described in C. F. Carlson U.S. Pat. No. 2,297,691. This process is also described in other U.S. patents, including for example, U.S. Pat. No. 2,277,013, U.S. Pat. No. 2,357,809, and U.S. Pat. No. 2,551,582, U.S. Pat. No. 3,220,324 and U.S. Pat. No. 3,220,833. The processes described in these patents generally involve the forming of a latent electrostatic charge image on an insulating electrophotographic element whereby the latent image is made visible by a development step wherein the charged surface of the photoconductive element is brought into contact with a suitable developer mix. As described in U.S. Pat. No. 2,297,691, for example, the resulting electrostatic latent image is developed by depositing on the image a finely-divided electroscopic material referred to in the art as toner. This toner is generally attracted to the areas of the layer which retain a charge, thereby forming a toner image corresponding to the electrostatic latent image and subsequently the toner image can be transferred to a support surface such as paper. This transferred image can then be permanently fixed to the support surface by using a variety of techniques including heat; however, other suitable fixing methods such as solvent or overcoating treatment may be used.

Numerous methods are known for applying the electroscopic particles to the electrostatic latent image including cascade development, touchdown and magnetic brush belt. In cascade development, as described in U.S. Pat. No. 2,618,552, a developer material comprising relatively large carrier particles having finely-divided toner particles electrostatically clinging to the surface of the carrier particles is conveyed to and rolled or cascaded across the electrostatic latent image bearing surface. The composition of the toner particles is selected in order to have a triboelectric polarity opposite to that of the carrier particles. Thus, as the mixture cascades or rolls across the image bearing surface, the toner particles are electrostatically deposited and secured to the charged portion of the latent image and are not deposited on the uncharged or background portions of the image. Carrier particles and unused toner particles can then be recycled. This process is fully described by E. N. Wise in U.S. Pat. No. 2,618,552.

In the touchdown process as described in U.S. Pat. Nos. 2,895,847 and 3,245,823, a developer material is carried to a latent image bearing surface by a support layer, such as a web or sheet and is deposited thereon in conformity with the image.

In magnetic brush development, a developer material comprising toner and magnetic carrier particles is carried by a magnet whereby the magnetic field of the magnet causes alignment of the magnetic carriers into engagement with an electrostatic latent image-bearing surface, causing the toner particles to be attracted from the developer to the electrostatic latent image by electrostatic attraction. This process is described more fully in U.S. Pat. No. 2,874,063.

Carrier materials used in the development of electrostatographic images are described in many patents including U.S. Pat. No. 3,590,000, the nature of the material being used being dependent on numerous factors such as the type of development used, the quality of the development desired, the type of photoconductor employed and other factors including durability. Generally, the materials used as carrier surfaces or carrier particles, or coatings thereon, should have a triboelectric value commensurate with the triboelectric value of the toner, in order to enable electrostatic adhesion of the toner to the carrier. Also, the triboelectric charging properties of the carrier should be relatively uniform in order to allow uniform pickup and subsequent deposition of toner. Further, carrier coatings should preferably have a certain hardness primarily for durability purposes but yet made of materials that will not scratch the plate or drum surface upon which the electrostatic image is initially placed. Carriers should also be selected that are not brittle so as to cause flaking of the surface or particle breakup under the forces exerted on the carrier during recycle as such will cause undesirable effects and could, for example, be transferred to the copy surface thereby reducing the quality of the final image. In addition, there are several types of carrier materials which, although having the proper triboelectric properties, are of limited use in a development system because of the limitations they possess, as described above, which result in undesirable results.

Some recent efforts have focused on the carrier particles, and more specifically the coating of these particles in order to obtain a better development system, particularly a developer that can be recycled and does not cause injury to the photoconductor. However, many of the coatings utilized deteriorate rapidly, particularly when used in a continuous process, and sometimes the entire coating separates from the carrier core in the form of chips or flakes which may be caused by poorly adhering coating material that fails upon impact and abrasive contact with machine parts and other carrier particles. Generally, such coated carrier particles cannot be reclaimed and reused, and further, poor print quality results when damaged carriers are not replaced. Also to be taken into consideration is the triboelectric and flow characteristics of coated carriers since such properties may be adversely affected when relative humidity is high. Thus, for example, the triboelectric values of some carrier coatings fluctuate when changes in relative humidity occur and such carriers are not desirable for use in electrostatic systems since they adversely affect the quality of the resulting image.

The importance of carrier coatings takes on increased emphasis in different development techniques. Generally, in order to develop a latent image comprised of negative electrostatic charges, an electroscopic powder and carrier combination is selected in which the powder is triboelectrically positive relative to the granular carrier. To develop a latent image comprised of positive electrostatic charges, such as when employing a selenium photoreceptor, an electroscopic powder and carrier is selected in which the powder is triboelectrically negative relative to the carrier. Thus, where the latent image is formed of negative electrostatic charges, such as when employing organic electrophotosensitive materials as the photoreceptor, it is desirable to develop the latent image with a positively charged electroscopic powder and a negatively charged carrier material.

PRIOR ART

A recent development in the art of providing coated carrier particles for electrostatographic development is disclosed by R. W. Madrid et al in U.S. Pat. No. 3,850,676. It is therein indicated that development may be obtained in an imaging system employing a developer mixture wherein the carrier particles are coated with a thin layer of a solid polyphenylene oxide resin or a blend of a polyphenylene oxide resin and a thermoplastic or thermosetting resin. The carrier particles are reported to possess high resistance to toner impaction and coating abrasion resistance. However, the triboelectric properties of these carrier materials are unsuitable for use in developing electrostatic latent images when the photoreceptor is charged to a negative polarity. Another effort in the art of providing coated carrier particles for electrostatographic development is reported by C. A. Queener et al in U.S. Pat. No. 3,778,262. The coating composition therein is formed of a mixture of a fluoropolymer and epoxy. After application to carrier cores, the coating composition is cured by heating the carrier particles at a temperature below 700° F. for about 15 minuites to ensure adherence of the coating to the cores and provide particles which have an electronegative characteristic with respect to toner particles. However, it has been found that such carrier particles possess coatings which are usually brittle and have poor adhesion properties with concomitant tendencies to separate, flake, or break away from the carrier cores. Consequently, the triboelectric charging properties of such carrier materials become non-uniform resulting in poor quality development and the useful life of the developer mixture is minimized. Thus, there is a continuing need for improved coated carrier particles for use in an electrostatographic imaging system.

SUMMARY OF THE INVENTION

It is therefore, an object of this invention to provide developer materials which overcome the above-noted deficiencies.

It is another object of this invention to provide carrier materials which have excellent adherence to carrier substrates.

It is a further object of this invention to provide carrier coatings which are more resistant to cracking, chipping, flaking, and have high tensile and compressive strength.

It is a further object of this invention to provide coated carrier materials having improved triboelectric characteristics, greatly increased life, better flowability properties, and which materials can be reclaimed if desired.

Furthermore, it is an object of this invention to provide improved developer materials, especially improved coated carrier materials which may be used in an electrostatographic development environment where the photoreceptor is charged to a negative polarity.

It is yet another object of this invention to provide improved coated carrier materials having physical and chemical properties superior to those of known developer materials.

The above objects and others are accomplished, generally speaking, by providing a carrier for electrostatographic developer mixtures comprising finely-divided toner particles electrostatically clinging to the surface of carrier particles wherein said carrier particles comprise a core having an outer coating thereon comprising a polyblend of a first polymer possessing negative triboelectric charging characteristics with respect to toner particles, and a second polymer which possesses strong adhesive properties with respect to said core.

In general, during application of the polymer blends of this invention to carrier cores and removal of the solvent such as by evaporation, separation of the polymers in the polyblend occurs so that the second polymer migrates to the surface of the carrier cores while the first polymer migrates to form the outer surface of the carrier core coating. In this manner, the polyblend coating materials of this invention provide carrier particles having improved properties and which can be used in an electrostatographic development system, especially where development of a negatively charged photoreceptor is desired. In accordance with this invention, it has been found that the carrier coating materials of this invention provide electrostatographic coated carrier materials which possess longer useful lives and which are capable of generating negative triboelectric charging properties. By comparison, copolymers of the same material compositions applied to carrier cores in identical manner provide coatings having poor adhesion, and in some cases, coatings which are brittle.

As the first polymer possessing satisfactory negative triboelectric charging characteristics with respect to toner particles may be employed soluble fluoropolymers such as vinylidene fluoride, for example, Kynar 201 available from Pennwalt Corporation, Philadelphia, Pa.; terpolymers comprising vinylidene fluoride, tetrafluoroethylene, and vinyl butyrate such as Fluoropolymer "B" available from E. I. duPont Co., Wilmington, Del.; and copolymers and homopolymers of fluorinated acrylates and methacrylates such as poly-hexafluoroisopropyl methacrylate.

As the second polymer possessing strong adhesive properties with respect to the carrier core may be employed soluble acrylics such as styrene and alkyl acrylates and methacrylates, for example, copolymers of styrene and methyl methacrylate, terpolymers of styrene, methyl methacrylate and an organosilane; methyl methacrylate and methacrylic acid copolymers, styrene and methacrylic acid copolymers; polymethacrylonitrile and copolymers thereof; acrylonitrile copolymers such as those containing vinylidene chloride; copolymers containing methacrylic acid and salts thereof; polysulfones; polycarbonates; polyesters such as polycaprolactone, polyhexamethylene terephalate; polyamides such as Trogamid T (poly 2,2,4-trimethylhexamethylene terephthalamide available from Dynamit Nobel of America); and other polyamides such as Amidel (a transparent Nylon® available from Union Carbide Corp., New York, N.Y.).

Any suitable combination of the aforementioned polymers may be employed as the polyblend to form the carrier coatings of this invention. Typical polyblends include hexafluoroisopropyl methacrylate and dimethylaminoethyl methacrylate; a terpolymer comprising about 70 molar percent of vinylidene fluoride, about 20 molar percent of tetrafluoroethylene, and about 10 molar percent of vinyl butyrate (such as "Fluoropolymer B", available from E. I. duPont Co., Wilmington, Del.) with styrene-methyl methacrylate copolymers; "Fluoropolymer B" with vinylidene chloride-acrylonitrile copolymers; fluoropolymers blended with amorphous, highly wax-compatible vinyl polymers such as Elvax ionomers available from E. I. duPont Co., Wilmington, Del., cellulose nitrate, polysulfones, polymethacrylonitrile, or copolymers of polymethacrylonitrile; mixtures of polycaprolactone or polyhexamethylene terephthalate with polyvinylidene fluoride, polyvinyl chloride, polyvinyl chloride-vinylidene chloride copolymers; blends of nitrocellulose, styrene-acrylonitrile copolymers, polyethylene, acrylonitrile-butadiene-styrene terpolymers, vinyl-chloride-acrylonitrile copolymers, and a fluoropolymer. Polycaprolactone has been found to be an especially effective dispersant for a variety of pigments in thermoplastic systems, and in particular, for dispersing carbon black in such systems.

Especially preferred polyblends include mixtures of a fluoropolymer and an acrylic copolymer or homopolymer containing polar groups such as carboxylic acid, amine or alcohol because the resulting carrier coatings have been found to possess strong adhesive properties and to provide the desired negative triboelectric charging characteristics. After application to carrier cores, these polyblends have been found to provide the combined properties of strong adhesion to carrier cores such as metal cores, mechanical toughness, and lower surface energies. Thus, by this invention, the major problem of poor carrier core adhesion associated with low surface energy carrier coatings has been overcome.

Any suitable ratio of first polymer may be employed with respect to the ratio of the second polymer in the polyblends for the electrostatographic carrier coatings of this invention. Typical ratios of the first polymer to the second polymer include from about 5 parts to about 95 parts by weight of the first polymer to from about 95 to about 5 parts by weight of the second polymer. However, it is preferred to employ from about 20 parts to about 80 parts of the first polymer to from about 80 parts to about 20 parts of the second polymer, all parts given being by weight, because coated carrier materials possessing more satisfactory physical and electrostatographic properties are obtained. In addition, it is preferred to employ as the first polymer a halogenated polymer such as a fluoropolymer because it migrates to the carrier coating surface and the coated carrier particles have low surface energies. Further, it is preferred to employ as the second polymer an acrylic polymer because the coating has good mechanical properties and adhesion to carrier cores, especially steel and ferrite cores.

It is to be noted that the polymer blends of this invention will possess various degrees of compatibility. On a scientific basis, a truly compatible polymer blend is one that displays a single glass transition intermediate between the glass transitions of the respective components. However, from a practical viewpoint, compatible polymer blends herein are those that can be readily prepared and display selected polymer properties equivalent or superior to the respective components. For illustration, the blending of 10 to 50 percent of polycaprolactone with polyethylene, polyvinyl chloride, vinyl chloride-vinylidene chloride, nitrocellulose, and styrene-acrylonitrile would be considered to result in compatible polyblends since the added polymer is readily dispersed in the host polymer matrix with no obvious sweat-out or deterioration in physical properties. Further two extreme cores can be distinguished. That is, where the polyblend results in complete phase separation, and where there is no phase separation. Practical polyblends of this invention are those where compatibility of the polyblend is intermediate between these extremes. It has been found that with a high degree of separation, the resulting carrier coating will generate triboelectric charging properties characteristic of the low surface energy polymer. Where the polyblend has a high degree of compatibility, the triboelectric charging properties of the carrier coating will be characteristic of the mixture. However, in all cases the advantage of improved carrier coating adhesion is obtained.

Any suitable polyblend coating weight or thickness may be employed to coat the carrier cores. However, a coating having a thickness at least sufficient to form a substantially continuous film is preferred because the carrier coating will then possess sufficient thickness to resist abrasion and minimize pinholes which may adversely affect the triboelectric properties of the coated carrier particles, and also in order that the desired triboelectric effect to the carrier is obtained and also to maintain a sufficient negative charge on the carrier, the toner being charged positively in such an embodiment so as to allow development of negatively charged images to occur. Generally, for cascade and magnetic brush development, the polyblend carrier coating may comprise from about 0.05 microns to about 3.0 microns in thickness on the carrier particle. Preferably, the coating should comprise from about 0.2 microns to about 0.7 microns in thickness on the carrier particle because maximum coating durability, toner impaction resistance, and copy quality are achieved. To achieve further variation in the properties of the final coated product, other additives such as plasticizers, reactive or non-reactive resins, dyes, pigments, conductive fillers such as carbon black, wetting agents and mixtures thereof may be mixed with the polyblend. In addition, where the carrier core is a conductive material, it is possible to provide carrier materials having conductive properties by providing the carrier core with a discontinuous or partial coating of the polyblends of this invention.

Any suitable well-known coated or uncoated carrier material may be employed as the core or substrate for the carriers of this invention. Typical carrier core materials include methyl methacrylate, glass, silicon dioxide, flintshot, ferromagnetic materials such as iron, steel, ferrite, nickel, and mixtures thereof. An ultimate coated carrier particle having an average diameter between about 30 microns to about 1,000 microns is preferred because the carrier particle then possesses sufficient density and inertia to avoid adherence to the electrostatic images during the development process. Adherence of carrier beads to an electrostatographic drum is undesirable because of the formation of deep scratches on the drum surface during the image transfer and drum cleaning steps, particularly where cleaning is accomplished by a web cleaner such as the web disclosed by W. P. Graff, Jr., et al. in U.S. Pat. No. 3,186,838.

Any suitable finely-divided toner material may be employed with the coated carriers of this invention. Typical toner materials include gum copal, gum sandarac, rosin, cumarone-indene resin, asphaltum, gilsonite, phenolformaldehyde resins, rosin modified phenolformaldehyde resins, methacrylic resins, polystyrene resins, epoxy resins, polyester resins, polyethylene resins, vinyl chloride resins, and copolymers or mixtures thereof. The particular toner material to be employed obviously depends upon the separation of the toner particles from the coated carrier beads in the triboelectric series. Among the patents describing electroscopic toner compositions are U.S. Pat. No. 2,659,670 to Copley; U.S.

Pat. No. 2,753,308 to Landrigan; U.S. Pat. No. 3,070,342 to Insalaco; U.S. Pat. No. 25,136 to Carlson and U.S. Pat. No. 2,788,288 to Rheinfrank et al. These toners generally have an average particle diameter between about 5 and 30 microns.

Any suitable pigment or dye may be employed as the colorant for the toner particles. Toner colorants are well known and include, for example, carbon black, nigrosine dye, aniline blue, Calco Oil Blue, chrome yellow, ultramarine blue, Quinoline Yellow, methylene blue chloride, Monastral Blue, Malachite Green Oxalate, lampblack, Rose Bengal, Monastral Red, Sudan Black BN, and mixtures thereof. The pigment or dye should be present in the toner in a sufficient quantity to render it highly colored so that it will form a clearly visible image on a recording member.

Any suitable conventional toner concentration may be employed with the coated carriers of this invention. Typical toner concentrations include about 1 part toner with about 10 to 200 parts by weight of carrier.

Any suitable well-known electrophotosensitive material may be employed as the photoreceptor with the coated carriers of this invention. Well-known photoconductive materials include vitreous selenium, organic or inorganic photoconductors embedded in a nonphotoconductive matrix, organic or inorganic photoconductors embedded in a photoconductive matrix, or the like. Representative patents in which photoconductive materials are disclosed include U.S. Pat. No. 2,803,542 to Ullrich, U.S. Pat. No. 2,970,906 to Bixby, U.S. Pat. No. 3,121,006 to Middleton, U.S. Pat. No. 3,121,007 to Middleton, and U.S. Pat. No. 3,151,982 to Corrsin.

Any suitable method may be employed to apply the polyblend coating materials to this invention to electrostatographic carrier cores. Typical methods include mixing, dipping, or spraying carrier cores with a solution or dispersion of the coating materials employing a vibratub or fluidized bed.

In the following examples, the relative triboelectric values generated by contact of carrier beads with toner particles are measured by means of a Faraday Cage. This device comprises a stainless steel cylinder having a diameter of about 1 inch and a length of about 1 inch. A screen is positioned at each end of the cylinder; the screen openings are of such a size as to permit the toner particles to pass through the openings but prevent the carrier particles from making such passage. The Faraday Cage is weighed, charged with about 0.5 grams of the carrier and toner mixture, reweighed, and connected to the input of a coulomb meter. Dry compressed air is then blown through the cylinder to drive all the toner from the carrier. As the electrostatically charged toner leaves the Faraday Cage, the oppositely charged carrier beads cause an equal amount of electronic charge to flow from the Cage, through the coulomb meter, to ground. The coulomb meter measures this charge which is then taken to be the charge on the toner which was removed. Next, the cylinder is reweighed to determine the weight of the toner removed. The resulting data is used to calculate the toner concentration and the average charge to mass ratio of the toner. Since the triboelectric measurements are relative, the measurements should, for comparative purposes, be conducted under substantially identical conditions. Obviously, other suitable toners may be substituted for the toner composition used in the examples.

DESCRIPTION OF THE PREFERRED EMBODIMENTS

The following examples, other than the control example, further define, describe and compare preferred methods of utilizing the carrier materials of the present invention in electrostatographic applications. Parts and percentages are by weight unless otherwise indicated.

EXAMPLE I

A control developer mixture is prepared by applying a coating solution containing about 10 percent solids comprising about 100 parts of a terpolymer comprising about 70 molar percent of vinylidene fluoride, about 20 molar percent of tetrafluoroethylene, and about 10 molar percent of vinyl butyrate (Fluoropolymer B, available from E. I. duPont Co., Wilmington, Del.) dissolved in methyl ethyl ketone to steel carrier particles having an average particle diameter of about 250 microns. The carrier cores and the coating solution are simultaneously heated and suspended in a water-jacketed vibratub coating apparatus (available from Vibraslide, Inc., Binghamton, N.Y.). The coating solution is applied to provide about 0.8 percent by weight of the coating material based on the weight of the coated cores. After removal of the solvent, the coated cores are post-treated by heating in a vacuum oven at about 80° C. for about 1 hour and then mixed with a toner material comprising a styrene-n-butyl methacrylate copolymer, carbon black, and about 0.25 percent by weight based on the weight of toner material of tetraethylammonium bromide wherein the toner material has an average particle size of between about 10 to 15 microns. The coated cores are blended with the toner material in an amount of about 1 part toner material per about 100 parts of carrier material. The developer mixture is roll-mill mixed for about 1 hour after which time the triboelectric charge generated on the toner particles is measured as indicated above. The triboelectric value is found to be about +20 micro-coulombs per gram of toner material.

A fresh sample of the developer mixture is used to develop a negatively charged photoconductive surface bearing an electrostatic latent image. It is found that the developer mixture produces images of satisfactory quality with satisfactory background levels below the maximum value of 0.020 deemed acceptable, and image solid area density is good. However, after making about 10,000 copies, it is found that the carrier coating gradually degrades with concomitant loss of triboelectric charging potential and copy quality becomes unsatisfactory.

EXAMPLE II

A developer mixture is prepared by applying a coating solution containing about 10 percent solids comprising about 60 parts of a terpolymer comprising about 70 molar percent of vinylidene fluoride, about 20 molar percent of tetrafluoroethylene, and about 10 molar percent of vinyl butyrate (Fluoropolymer B, available from E. I. duPont Co., Wilmington, Del.) and about 40 parts of styrene methyl methacrylate (60:40) copolymer dissolved in methyl ethyl ketone to steel carrier particles having an average particle diameter of about 250 microns, the carrier cores and the coating solution are simultaneously heated and suspended in a water-jacketed vibratub coating apparatus (available from Vibraslide, Inc., Binghamton, N.Y.). The coating solution is applied to provide about 0.8 percent by weight of the coating material based on the weight of the coated cores. After removal of the solvent, the coated cores are posttreated by heating in a vacuum oven at about 8° C. for about 1 hour and then mixed with the toner material of Example I. The coated cores are blended with the toner material in an amount of about 1 part toner material per about 100 parts of carrier material. The developer mixture is roll-mill mixed for about 1 hour after which time the triboelectric charge generated on the toner particles is measured as indicated above. The triboelectric value is found to be about +20 microcoulombs per gram of toner material.

A fresh sample of the developer mixture is used to develop a negatively charged photoconductive surface bearing an electrostatic latent image. It is found that the developer mixture produces images of excellent quality with satisfactory background levels well below the maximum value of 0.020 deemed acceptable, and image solid area density is good. After making about 10,000 copies, it is found that carrier coating adhesion is excellent, toner impaction on the carrier coating is insignificant, there is no loss in triboelectric charging values, and copy quality is still excellent.

EXAMPLE III

A developer mixture is prepared by applying a coating solution containing about 10 percent solids comprising about 40 parts of polycaprolactone and 60 parts of polyvinylidene fluoride (Kynar 201, available from Pennwalt Corp., Philadelphia, Pa.) dissolved in methyl ethyl ketone to steel carrier particles having an average particle diameter of about 250 microns. The carrier cores and the coating solution are simultaneously heated and suspended in a water-jacketed vibratub coating apparatus (available from Vibraslide, Inc., Binghamton, N.Y.). The coating solution is applied to provide about 0.8 percent by weight of the coating material based on the weight of the coated cores. After removal of the solvent, the coated cores are post-treated by heating in a vacuum oven at about 80° C. for about 1 hour and then mixed with the toner material of Example I. The coated cores are blended with the toner material in an amount of about 1 part toner material per about 100 parts of carrier material. The developer mixture is roll-mill mixed for about 1 hour after which time the triboelectric charge generated on the toner particles is measured as indicated above. The triboelectric value is found to be about +17 micro-coulombs per gram of toner material.

A fresh sample of the developer mixture is used to develop a negatively charged photoconductive surface bearing an electrostatic latent image. It is found that the developer mixture produces images of excellent quality with satisfactory background levels well below the maximum value of 0.020 deemed acceptable, and image solid area density is good. After making about 10,000 copies, it is found that carrier coating adhesion is excellent, toner impaction on the carrier coating is insignificant, there is no loss in tribroelectric charging values, and copy quality is still excellent.

EXAMPLE IV

A developer mixture is prepared by applying a coating solution containing about 10 percent solids comprising about 55 parts of Fluoropolymer B (available from E. I. duPont Co., Wilmington, Del.), about 25 parts of styrene-methylmethacrylate (60:40) copolymer, and about 20 parts of conductive carbon black particles dissolved in methyl ethyl ketone to steel carrier particles having an average particle diameter of about 250 microns. The carrier cores and the coating solution are simultaneously heated and suspended in a water-jacketed vibratub coating apparatus (available from Vibraslide, Inc., Binghamton, N.Y.). The coating solution is applied to provide about 0.8 percent by weight of the coating material based on the weight of the coated cores. After removal of the solvent, the coated cores are post-treated by heating in a vacuum oven at about 80° C. for about 1 hour and then mixed with the toner material of Example I. The coated cores are blended with the toner material in an amount of about 1 part toner material per about 100 parts of carrier material. The developer mixture is roll-mill mixed for about 1 hour after which time the triboelectric charge generated on the toner particles is measured as indicated above. The triboelectric value is found to be about +15 microcoulombs per gram of toner material.

A fresh sample of the developer mixture is used to develop a negatively charged photoconductive surface bearing an electrostatic latent image. It is found that the developer mixture produces images of excellent quality with satisfactory background levels well below the maximum value of 0.020 deemed acceptable, and image solid area density is good. After making about 10,000 copies, it is found that carrier coating adhesion is excellent, toner impaction on the carrier coating is insignificant, there is no loss in triboelectric charging values, and copy quality is still excellent.

Although specific material and conditions were set forth in the above exemplary processes in making and using the developer materials of this invention, these are merely intended as illustrations of the present invention. Various other toners, carrier cores, substituents and processes such as those listed above may be substituted for those in the examples with similar results.

Other modifications of the present invention will occur to those skilled in the art upon reading the present disclosure. These are intended to be included with the scope of this invention.

What is claimed is:

1. A carrier particle for electrostatographic developer mixtures, said carrier particle comprising a core having an average diameter of from between about 30 microns and about 1,000 microns, said core having an outer coating comprising a polyblend of a first polymer possessing negative triboelectric charging characteristics with respect to toner particles and a second polymer possessing strong adhesive properties with respect to said core, said first polymer comprising a fluoropolymer selected from the group consisting of polymers of vinylidene fluoride, tetrafluoroethylene, and fluorinated acrylates and methacrylates, and said second polymer being selected from the group consisting of polycaprolactone, polysulfones, polycarbonates, polyesters, polyamides, and polymers of styrene, alkyl acrylates, alkyl methacrylates, organosilanes, and acrylonitriles.

2. A carrier particle for electrostatographic developer mixtures in accordance with claim 1 wherein said first polymer comprises about 70 molar percent of vinylidene fluoride, about 20 molar percent of tetrafluorethylene, and about 10 molar percent of vinyl butyrate, and said second polymer comprises a styrene-alkyl methacrylate copolymer.

3. A carrier particle for electrostatographic developer mixtures in accordance with Claim 1 wherein said first polymer comprises vinylidene fluoride and said second polymer comprises polycaprolactone.

4. A carrier particle for electrostatographic developer mixtures in accordance with claim 1 wherein said outer coating is present in an amount of from between about 0.05 microns and about 3.0 microns in thickness.

5. A carrier particle for electrostatographic developer mixtures in accordance with claim 1 wherein said first polymer is present in the amount of from about 5 parts to about 95 parts by weight and said second polymer is present in the amount of from about 95 parts to about 5 parts by weight.

6. A carrier particle for electrostatographic developer mixtures in accordance with claim 1 wherein said core comprises an electrically conductive material, said outer coating is discontinuous, and said carrier particle is electrically conductive.

7. A carrier particle for electrostatographic developer mixtures in accordance with claim 1 wherein said core is a ferromagnetic material selected from the group consisting of iron, steel, nickel, and ferrites.

8. An electrostatographic developer mixture comprising finely-divided toner particles electrostatically clinging to the surface of carrier particles, each of said carrier particles comprising a core having an average diameter of from between about 30 microns and about 1,000 microns, said core having an outer coating comprising a polyblend of a first polymer which comprises a halogenated polymer possessing negative triboelectric charging characteristics with respect to said toner particles and a second polymer which comprises an acrylic polymer possesssing strong adhesive properties with respect to said core, said first polymer comprising a fluoropolymer selected from the group consisting of polymers of vinylidene fluoride, tetrafluoroethylene, and fluorinated acrylates and methacrylates, and said second polymer being selected from the group consisting of polycarpolactone, polysulfones, polycarbonates, polyesters, polyamides, and polymers of styrene, alkyl acrylates, alkyl methacrylates, organosilanes, and acrylonitriles.

9. An electrostatographic imaging process comprising the steps of providing an electrostatographic imaging member having a recording surface, forming a negatively charged electrostatic latent image on said recording surface, and contacting said electostatic latent image with a developer mixture comprising finely-divided toner particles electrostatically clinging to the surface of carrier particles, each of said carrier particles comprising finely-divided toner particles electrostatically clinging to the surface of carrier particles, each of said carrier particles comprising a core having an average diameter of from between about 30 microns and about 1,000 microns, said core having an outer coating comprising a polyblend of a first polymer which comprises a halogenated polymer possessing negative triboelectric charging characteristics with respect to said toner particles, and a second polymer which comprises an acrylic polymer possessing strong adhesive properties with respect to said core, said first polymer comprising a fluoropolymer selected from the group consisting of polymers of vinylidene fluoride, tetrafluoroethylene, and fluorinated acrylates and methacrylates, and said second polymer being selected from the group consisting of polycaprolactone, polysulfones, polycarbonates, polyesters, polyamides and polymers of styrene, alkyl arylates, alkyl methacrylates, organosilanes, and acrylonitriles, whereby at least a portion of said finely-divided toner particles are attracted to and deposited on said recording surface in conformance with said electrostatic latent image.

* * * * *